United States Patent [19]

Stevens

[11] Patent Number: 4,624,505

[45] Date of Patent: Nov. 25, 1986

[54] MINERAL CUTTER PICKS AND PICK ASSEMBLIES

[75] Inventor: Peter Stevens, Coventry, United Kingdom

[73] Assignee: Santrade Ltd., Lucerne, Switzerland

[21] Appl. No.: 691,646

[22] Filed: Jan. 15, 1985

[30] Foreign Application Priority Data

Jan. 19, 1984 [GB] United Kingdom ..... 8401403

[51] Int. Cl.[4] ..... E21C 35/22; E21F 5/02

[52] U.S. Cl. ..... 299/81; 299/17

[58] Field of Search ..... 299/81, 17; 175/339, 175/340, 393; 279/20; 285/166, 261, 266

[56] References Cited

U.S. PATENT DOCUMENTS

| | | | |
|---|---|---|---|
| 2,740,646 | 4/1956 | Bard | 285/261 X |
| 3,404,904 | 10/1968 | Roe | 285/266 X |
| 4,488,758 | 12/1984 | Clemmow et al. | 299/81 |
| 4,573,744 | 3/1986 | Clemmow et al. | 299/81 |
| 4,583,786 | 4/1986 | Thorpe et al. | 299/81 |

FOREIGN PATENT DOCUMENTS

| | | | |
|---|---|---|---|
| 41818 | 4/1978 | Japan | 285/166 |
| 1057830 | 2/1967 | United Kingdom | 299/81 |
| 2019920 | 11/1979 | United Kingdom | 299/81 |
| 2036127 | 6/1980 | United Kingdom | 299/81 |
| 2104945 | 3/1983 | United Kingdom | 299/81 |

*Primary Examiner*—James A. Leppink
*Assistant Examiner*—Michael A. Goodwin
*Attorney, Agent, or Firm*—Burns, Doane, Swecker & Mathis

[57] ABSTRACT

A mineral cutter pick is mounted in a holder. Passages in the pick and the holder supply fluid to an opening near the pick cutting edge. Sleeves are provided in the adjacent ends of the passages in the pick and holder and receive the opposite ends of a tubular connector. At least one of the sealing sleeves has its outer face exposed to the fluid supply pressure so that sealing with the associated end of the connector is assisted by the pressure force. The ends of the connector are formed as spherical enlargements to allow free pivoting in their sleeves and at least one end is axially displaceable in its sleeve while maintaining sealing contact.

6 Claims, 4 Drawing Figures

MINERAL CUTTER PICKS AND PICK ASSEMBLIES

BACKGROUND AND SUMMARY OF THE INVENTION

This invention relates to mineral cutter picks and pick assemblies for mineral mining, e.g. for coal cutting.

In mining operations it is often desirable to use a fluid spray close to the cutting face in order to limit the spread of dust and/or for cooling. It is of course desirable that the fluid should be directed very close to the cutting operation to be effective, and it has been proposed to direct a flow of water through a passage that extends through a cutting pick from an entry in the rear face of a shank of the pick to near its cutting tip. The water is fed from supply conduit in a cutter head in which a number of picks are held, and there are tubular elements provided for a plug-in connection for each pick as the picks are mounted on the cutter head.

Leakage from such a connection can be a problem, because it must be realised that in the difficult and dirty conditions that usually obtain in mining operations, it is difficult to provide and maintain close tolerances.

According to one aspect of the invention, there is provided a pick assembly comprising a cutter pick and holding means for said pick having an aperture in which a shank of the pick is received, passages being provided in said holding means and the pick for the supply of fluid to an opening adjacent a cutting tip of the pick, connector means between said passages of the holding means and the pick comprising a tubular element received in sealing means in such a manner as to accommodate displacement between the connected passages, said sealing means comprising a sleeve at an end region of one of said passages and having an inner face in engagement with an end of the tubular element and an outer face which is exposed to the supply pressure of said passage end region, whereby to assist sealing of the tubular element outer periphery therewith.

Preferably, the application of fluid pressure to said outer face of the sleeve is obtained by providing an annular space around the sleeve opening into the adjacent fluid passage.

Advantageously sealing sleeves are provided in the adjacent end regions of said passages in both the holding means and the pick, each with an outer face exposed to the supply fluid pressure to engage respective ends of a separate tubular connecting element. The sealing sleeves do not need to have corresponding forms, however.

Leakage from a fluid connection to a passage in a cutter pick can also occur because of movements between the pick and its holding means, for example, the conventional pick shank (other than those with fitted tapers) does not match its mounting slot exactly and in any case during use a slackness can develop. The cutter pick is then not fixed rigidly to the cutter head and the method of connection of the fluid supply to it must therefore allow for significant movement of the pick in its mounting.

According to a further aspect of the present invention, there is provided a pick assembly comprising a cutter pick and holding means for said pick having an aperture in which a shank of the pick is received, passages being provided in said holding means and the cutter pick for the supply of fluid to an opening adjacent a cutting tip of the pick, connector means between said passages of the holding means and the pick comprising a tubular element having opposite ends of larger external cross-section than an intermediate region between said ends, sealing means adjacent the ends of the passages in the tool and holding means engaging said larger ends of the tubular element in a manner permitting pivoting movements of both said ends and reciprocating movements of at least one of said ends on contacting faces of said sealing means, whereby to accommodate misalignment between the connected passages.

Preferably, said larger ends of the tubular element are part-spherical in form. It is also preferred that the sealing means engage said larger ends so as to restrain axial movement relative thereto, the sealing means for one of said passages having a lesser resistance to said axial movement for allowing reciprocatory movements when in use and during sliding engagement and disengagement of the tubular element therewith.

The invention is also directed to sealing means for use in a pick assembly as aforesaid, and to cutter picks and pick holding means provided with such sealing means.

BRIEF DESCRIPTION OF THE DRAWINGS

The invention will be described by way of example with reference to the accompanying diagrammatic drawings, in which.

DETAILED DESCRIPTION OF A PREFERRED EMBODIMENT OF THE INVENTION

Figure 1:
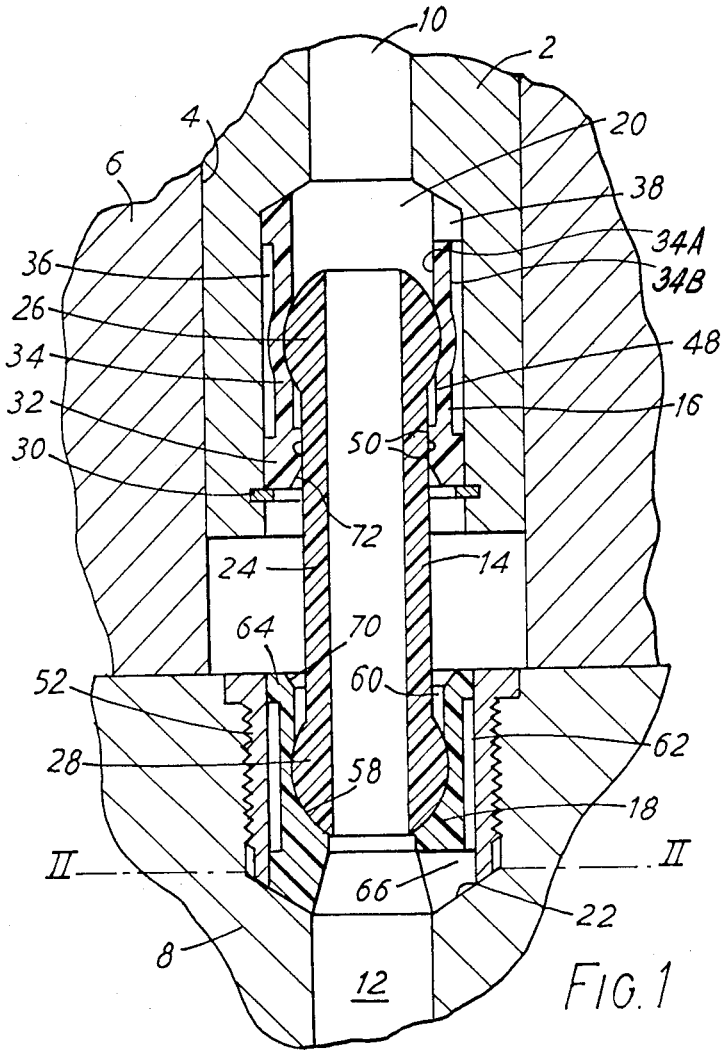
FIG. 1 is a fragmentary sectional view on the line I—I in FIG. 1 of the liquid flow connection between a cutter pick and its holding means in an assembly according to the invention.
Figure 2:
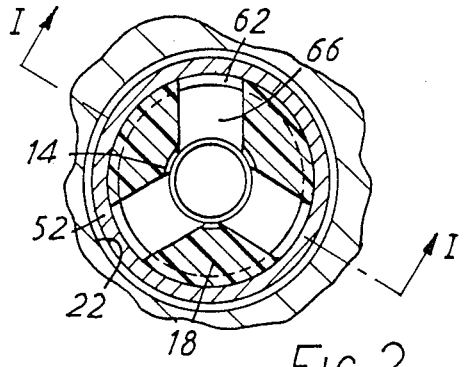
FIG. 2 is a cross section on the line II—II in FIG. 1.

FIG. 1 illustrates a portion of a pick assembly in which a shank 2 of a cutter pick is received in slot 4 of a pick box 6 on a cutter head 8 that is provided with a number of such boxes and picks. The pick box 6 and cutter head 8 form a holder for the pick. Each pick has a fluid passage 10 extending through it, from the rear end of its shank to one or more openings (not shown) adjacent the cutting edge of the pick, e.g. as is known from British Patent No. 1,006,819. Water is supplied to all the picks through conduits 12 in the cutter head, and because of the difficulty of providing an adequate seal between the pick shank and its receiving slot in the pick box, a sealing connection joins each passage to its supply conduit, as will now be described.

The connection comprises a tubular piece 14, e.g. of hard rubber, inserted in resilient sealing sleeves 16,18 in respective counterbores 20,22 at the adjacent ends of the passage 10 and the cutter head conduit 12. The tubular piece comprises a main cylindrical portion 24 intermediate two end portions 26,28 of part-spherical form that have a larger cross-section than the intermediate portion and that are engaged by the sealing sleeves in a fluid-tight manner.

The pick passage sealing sleeve 16 is held in its counterbore by a spring clip 30 and has a lower larger diameter end portion 32 that seals against the counterbore wall, and a smaller diameter inner wall portion 34 defining an annular space 36 with that wall. The wall 34 includes an inner face 34A engaging the head 26, and an outer face 34B facing the space 36. Between the sleeve and the inner end of the counterbore, a series of recesses 38 connect the annular space 36 around the inner sleeve portion with the pick passage 10.

The sleeve has a plain internal bore slightly smaller than the associated head 26 of the connector piece. Immediately adjacent the engaged head of the connector piece, there is a space 48 formed between the adjoining region of the intermediate portion and the inside wall of the sleeve. Towards the outer end of the sleeve, however, two annular locating ribs 50 may be provided to engage the intermediate portion lightly and so prevent the ingress of debris.

The cutter head sealing sleeve 18 is bonded to a metal bush 52 that is screwed into the counterbore 22. The sleeve has a part-spherical groove 58 into which the associated enlarged head 28 of the connector piece is sealingly received and an annular space 60 is formed between the sleeve and the connector piece outwardly of the engaged head. A further annular space 62 is formed between the sleeve and its bush around the engaged head. An outer rim 64 of the sleeve seals one end of the annular space, but the other end communicates through openings 66 with the cutter head conduit 12.

When a cutter pick is to be inserted into a pick box, the connector piece 14 is slid into the sealing sleeve 18 in the cutter head to locate the enlarged head 28 in the sleeve internal groove 58, the initial insertion being eased by an entry chamfer 70. When the cutter pick is slid into its pick box slot 4 the projecting end of the connector piece is guided by an entry chamfer 72 into the cutter pick sealing sleeve 16 and the head 26 is received in the sleeve, deforming the sleeve slightly as shown. In some cases there may be preformed recesses or grooves in both sealing sleeves to receive the enlarged end portions of the connector piece.

When the cutter head is in operation, water under pressure flows through its conduits 12 to the pick passages 10. In each connection the water is also admitted to the two annular spaces 36,62, so that its pressure assists the sealing of the sleeves 16,18 against the respective heads 26,28 of the connector piece. Any misalignment or movement of the cutter pick in its pick box, e.g. due to the combined effects of wear and vibration, will cause the pick to move relative to the cutter head, but considerable displacement can occur without affecting the efficiency of sealing. Thus, the connector piece is able to pivot on either part-spherical head 26,28 while maintaining an unchanged sealing interface. Also, because of the presence of the annular space 48 extending outwards from the head 26, some lateral displacement is possible without affecting sealing.

Some possible modifications of the construction described above are illustrated in FIG. 3. A cutter head sealing sleeve 78 is provided which is similarly bonded to a screwed metal brush 52 but the sleeve 78 does not provide an annular fluid pressure space around the connector piece head 28. Nor is there an inner annular space between the sleeve 78 and the connector piece 14, but the sleeve recess 58 directly adjoins the end chamfer 70 so that the connector piece can pivot on the head 28 without affecting its seal with the sleeve.

At its other end, the connector piece 14 has its increased cross-section head 76 formed by a collar **76*a* of another material, e.g. metal or plastics, producing less friction on the rubber sleeve. Also, the outer end of the annular space 36 surrounding the pick sealing sleeve is closed by a metal outer ring 80** bonded to the sleeve through which the sealing sleeve is secured to the pick counterbore.

Figure 3:
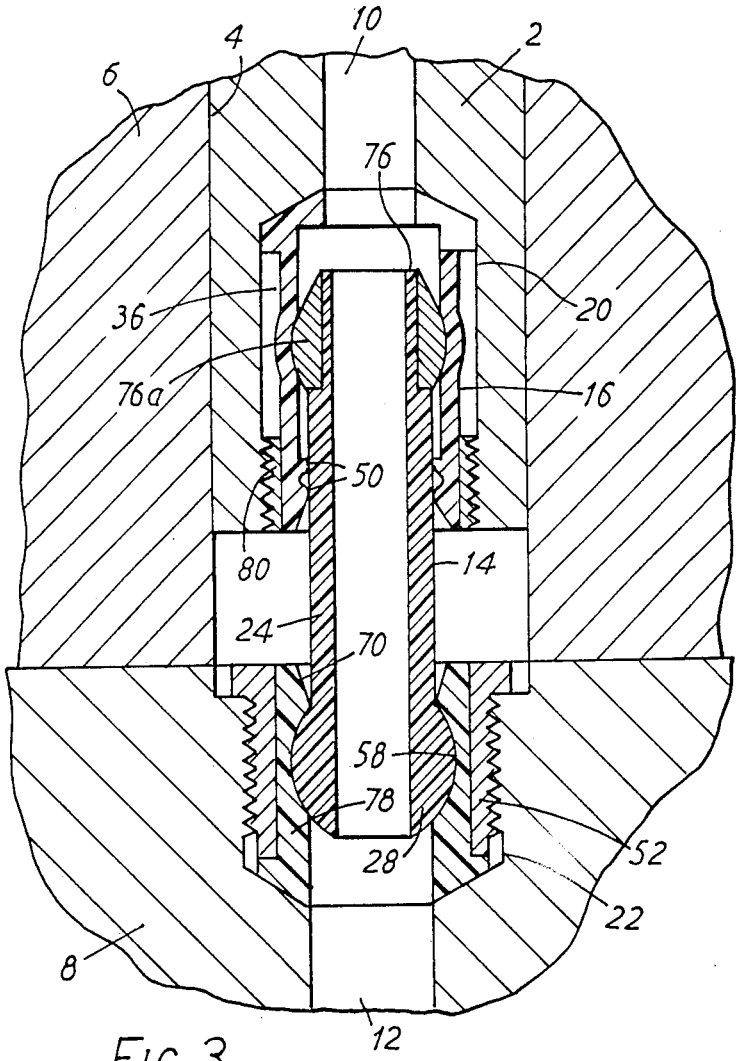
FIG. 3 is a sectional view similar to FIG. 1 showing a modified form of the invention.

The arrangement shown in FIG. 3 is particularly suitable for use with cutter picks that are arranged to be rotatable about the shank longitudinal axis in operation, but the individual features may be applicable to other forms of pick assembly.

Figure 4:
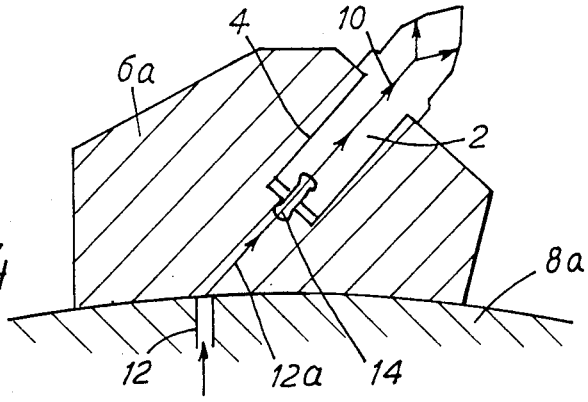
FIG. 4 is a schematic illustration of a liquid flow connection in a modified form of assembly according to the invention.

It will be well known from the art that a number of different configurations have been used for holding cutter picks and it will be appreciated without detailed illustration that the present invention is generally applicable to an arrangement in which the pick is mounted in a bore in any form of holding means provided with a passage for the supply of fluid to the pick. One alternative arrangement to that described in some detail with reference to the preceding figures is illustrated in outline in FIG. 4. This shows one of a number of pick boxes mounted on the periphery of a cutter drum **8*a* having passages 12 for supplying fluid to the picks 2. The pick box slot 4 here terminates some distance from the interface between the pick box and the cutter drum, and a connecting passage 12*a* is provided between the cutter drum and the slot. The connecting and sealing means provided between the passages 12*a* and 10** can be identical to either of the embodiments described above.

It will be understood that many modifications are possible within the scope of the invention. For example, it is possible to employ a tubular connecting piece that is an integral extension of the pick shank or its holding means. Such an arrangement can also cooperate effectively with sealing means that are assisted in their operation by the fluid supply pressure. It is also possible of course to utilize a separate connecting piece with some other form of sealing at its opposite end. It will be further understood that it is not necessary to provide an annular pressure chamber around a cylindrical outer wall of a sealing sleeve to obtain the assistance of the fluid pressure in maintaining the seal.

What I claim is:

1. A pick assembly comprising a cutter pick and a holder having an aperture in which a shank of the pick is received, first and second passages being provided in said holder and pick, respectively, conducting fluid to an opening adjacent a cutting tip of the pick, a fluid connector extending longitudinally between said holder and pick for conducting fluid therebetween while permitting relative longitudinal and lateral movement therebetween, said connector comprising a hollow tubular element extending longitudinally between said first and second passages for conducting fluid therebetween, said tubular element having an intermediate portion and first and second enlarged portions at the ends thereof, first and second sealing means disposed in said first and second passages, respectively, each of said sealing means comprising a sleeve having end portions engaging a wall of the respective passage and a resilient wall extending between said end portions, said wall surrounding a respective one of said first and second enlarged portions and including an inner face engaging the respective enlarged portion, and an outer face spaced radially inwardly with respect to a wall of the respective passage to form an annular space circumferentially surrounding the respective enlarged portion to permit relative lateral movement between said pick and holder, said annular space having a larger dimension in the longitudinal direction than the respective enlarged portion, said annular space being exposed to the pressure of fluid in the respective passage for biasing said inner face against the respective enlarged portion.

2. A pick assembly according to claim 1, wherein said inner face of one of said sleeves is of smaller cross-section than the cross-section of the respective enlarged portion to maintain snug sealing engagement therewith during relative longitudinal movement therebetween.

3. A pick assembly according to claim 1, wherein each said sleeve includes a first end disposed adjacent the other said sleeve and a second end remote from said first end, said first end of each sleeve forming a fluid seal against the wall of the associated passage, said annular space of each sleeve being exposed to fluid pressure through openings in said remote end.

4. A pick assembly according to claim 1, wherein at least one of said sleeves comprises a rigid member and a resilient member bonded thereto, said rigid member secured within the associated passage, said resilient member including said resilient wall.

5. A pick assembly according to claim 4, wherein said rigid member is threadedly secured within the associated passage.

6. A pick assembly according to claim 1, including a removable clip for securing at least one of said sleeves within its associated passage.

* * * * *